US011730330B2

(12) United States Patent
Chen et al.

(10) Patent No.: US 11,730,330 B2
(45) Date of Patent: Aug. 22, 2023

(54) FLOOR WASHING MACHINE

(71) Applicant: SUMEC HARDWARE & TOOLS CO., LTD., Nanjing (CN)

(72) Inventors: Lin-Miao Chen, Nanjing (CN); Feng Zhou, Nanjing (CN)

(73) Assignee: SUMEC HARDWARE & TOOLS CO., LTD., Nanjing (CN)

( * ) Notice: Subject to any disclaimer, the term of this patent is extended or adjusted under 35 U.S.C. 154(b) by 302 days.

(21) Appl. No.: 17/060,267

(22) Filed: Oct. 1, 2020

(65) Prior Publication Data

US 2022/0087496 A1 Mar. 24, 2022

(30) Foreign Application Priority Data

Sep. 18, 2020 (CN) ..... 202010991835.3

(51) Int. Cl.
*A47L 11/282* (2006.01)
*A47L 11/24* (2006.01)
*A47L 11/40* (2006.01)

(52) U.S. Cl.
CPC ..... *A47L 11/282* (2013.01); *A47L 11/24* (2013.01); *A47L 11/4005* (2013.01); *A47L 11/4008* (2013.01); *A47L 11/4011* (2013.01); *A47L 11/4041* (2013.01); *A47L 11/4072* (2013.01);

(Continued)

(58) Field of Classification Search
CPC .. A47L 11/282; A47L 11/4005; A47L 11/185; A47L 11/4041; A47L 11/4072; A47L 11/4011; A47L 11/065; A47L 11/085; A47L 11/125; A47L 11/145;

(Continued)

(56) References Cited

U.S. PATENT DOCUMENTS 6,463,616 B1 * 10/2002 Morokutti ..... A47L 11/292 15/83
2007/0089252 A1 * 4/2007 Wilkins ..... A47L 13/26 15/24
2016/0236217 A1 * 8/2016 Jenkins ..... A47L 11/4005

(Continued)

FOREIGN PATENT DOCUMENTS

CN 2459868 Y * 12/2000
EP 3287061 B1 * 4/2020 ..... A46B 13/001

OTHER PUBLICATIONS

Machine translation CN2459868Y (Year: 2022).*
Translation of EP3287061B (Year: 2023).*

*Primary Examiner* — Don M Anderson
*Assistant Examiner* — Sarah Akyaa Fordjour
(74) *Attorney, Agent, or Firm* — Muncy, Geissler, Olds & Lowe, P.C.

(57) ABSTRACT

A floor washing machine includes a handle assembly; a control unit provided at the handle assembly; a power supply unit electrically connected to the control unit; a rod assembly connected to the handle assembly; a base assembly connected to a lower portion of the rod assembly; a sweeping/scrubbing assembly provided at the base assembly and having a motor controlled by the control unit and a scrubbing roller to be driven into forward or reverse rotation by the motor; and a water supply assembly having a water outlet pipe, wherein the water outlet pipe has a water outlet opening and can be rotated in order to point the water outlet opening to a forward-of-roller direction or a rearward-of-roller direction of the sweeping/scrubbing assembly.

10 Claims, 9 Drawing Sheets

(52) U.S. Cl.
CPC ..... *A47L 11/4075* (2013.01); *A47L 11/4088* (2013.01)

(58) Field of Classification Search
CPC .. A47L 11/161; A47L 11/1625; A47L 11/201; A47L 11/4088; A47L 11/26; A47L 11/24
See application file for complete search history.

(56) References Cited

U.S. PATENT DOCUMENTS

2019/0082920 A1* 3/2019 Chavana, Jr. et al. ..... A47L 11/4075
2020/0214527 A1* 7/2020 Resch ..... A47L 11/4094

* cited by examiner

FLOOR WASHING MACHINE

BACKGROUND OF THE INVENTION

1. Technical Field

The present invention relates to a cleaning tool and more particularly to a machine for washing or scrubbing the floor.

2. Description of Related Art

Known floor washing machines have a sweeping/scrubbing assembly and a water output assembly. The water outlet of the water output assembly corresponds in position to the front side of the sweeping/scrubbing assembly such that when the machine is moved rearward during use, the floor will be swept/scrubbed before being sprayed with water, which compromises the cleaning effect and therefore requires improvement. Moreover, known floor washing machines are heavy and hence call for a considerable force exerted by a user's hand to sustain prolonged use, which also requires improvement.

BRIEF SUMMARY OF THE INVENTION

The primary objective of the present invention is to provide a floor washing machine that can spray water in the forward or rearward direction of the scrubbing roller to enable effective cleaning by the sweeping/scrubbing assembly.

To achieve the above objective, the present invention provides a floor washing machine that includes a handle assembly, a control unit, a power supply unit, a rod assembly, a base assembly, a sweeping/scrubbing assembly, and a water supply assembly. The handle assembly has a handle body. The control unit is provided at the handle assembly. The power supply unit is electrically connected to the control unit. The rod assembly is connected to the handle assembly and has a rod member. The base assembly is connected to a lower portion of the rod assembly. The sweeping/scrubbing assembly is provided at the base assembly and has a motor and a scrubbing roller. The motor works under the control of the control unit, and the scrubbing roller is driven to rotate by the motor. The direction forward of the scrubbing roller is defined as a forward-of-roller direction, and the direction rearward of the scrubbing roller as a rearward-of-roller direction. The scrubbing roller can be driven into forward rotation or reverse rotation by the motor. The water supply assembly has a water delivery member and a water outlet pipe. The water outlet pipe is rotatably connected to the water delivery member and has a water outlet opening. The water outlet pipe of the water supply assembly can be rotated in order to point the water outlet opening of the water outlet pipe to the forward-of-roller direction or the rearward-of-roller direction of the sweeping/scrubbing assembly.

Now that the water outlet pipe of the water supply assembly is rotatably adjustable to spray water in the forward or rearward direction of the scrubbing roller, effective water-assisted cleaning can be ensured whether the scrubbing roller is moved forward or rearward.

Preferably, the water delivery member of the water supply assembly has a first pipe and a second pipe connected to the first pipe, and the water outlet pipe is connected to the second pipe.

Preferably, the base assembly has a water outlet pipe engaging groove, and the water outlet pipe of the water supply assembly can be positioned in the water outlet pipe engaging groove of the base assembly.

Preferably, the water delivery member of the water supply assembly is connected to and extends through the handle assembly.

Preferably, the floor washing machine further includes a supporting wheel assembly. The supporting wheel assembly has a support arm and a wheel. The support arm is connected to the rod assembly, and the wheel is pivotally connected to the support arm. The supporting wheel assembly serves as a supporting element to reduce the force required to be exerted by the user's hand.

Preferably, the rod assembly has a collar provided on the rod member in a position-adjustable manner, and the support arm of the supporting wheel assembly is connected to the collar.

Preferably, the collar of the rod assembly has a plurality of positioning grooves, and the support arm of the supporting wheel assembly is formed with a plurality of positioning teeth that can be respectively engaged in the corresponding positioning grooves of the collar to secure the supporting wheel assembly at an arbitrary one of a plurality of predetermined rotated positions.

Preferably, the support arm of the supporting wheel assembly is formed with an arm groove for receiving the rod member of the rod assembly.

Preferably, the power supply unit is provided under the handle assembly, the water delivery member of the water supply assembly is connected to a water source pipe, and the handle assembly has a guard plate that can be pivoted to shield the power supply unit or the water source pipe.

Preferably, the control unit has a switch trigger, a flow regulating valve, and a setting and display device. The switch trigger is configured for use to activate the sweeping/scrubbing assembly, the flow regulating valve to regulate the amount of water output from the water outlet pipe, and the setting and display device to set the scrubbing roller of the sweeping/scrubbing assembly to a forward or reverse rotation mode.

DETAILED DESCRIPTION OF THE INVENTION

Figure 1:
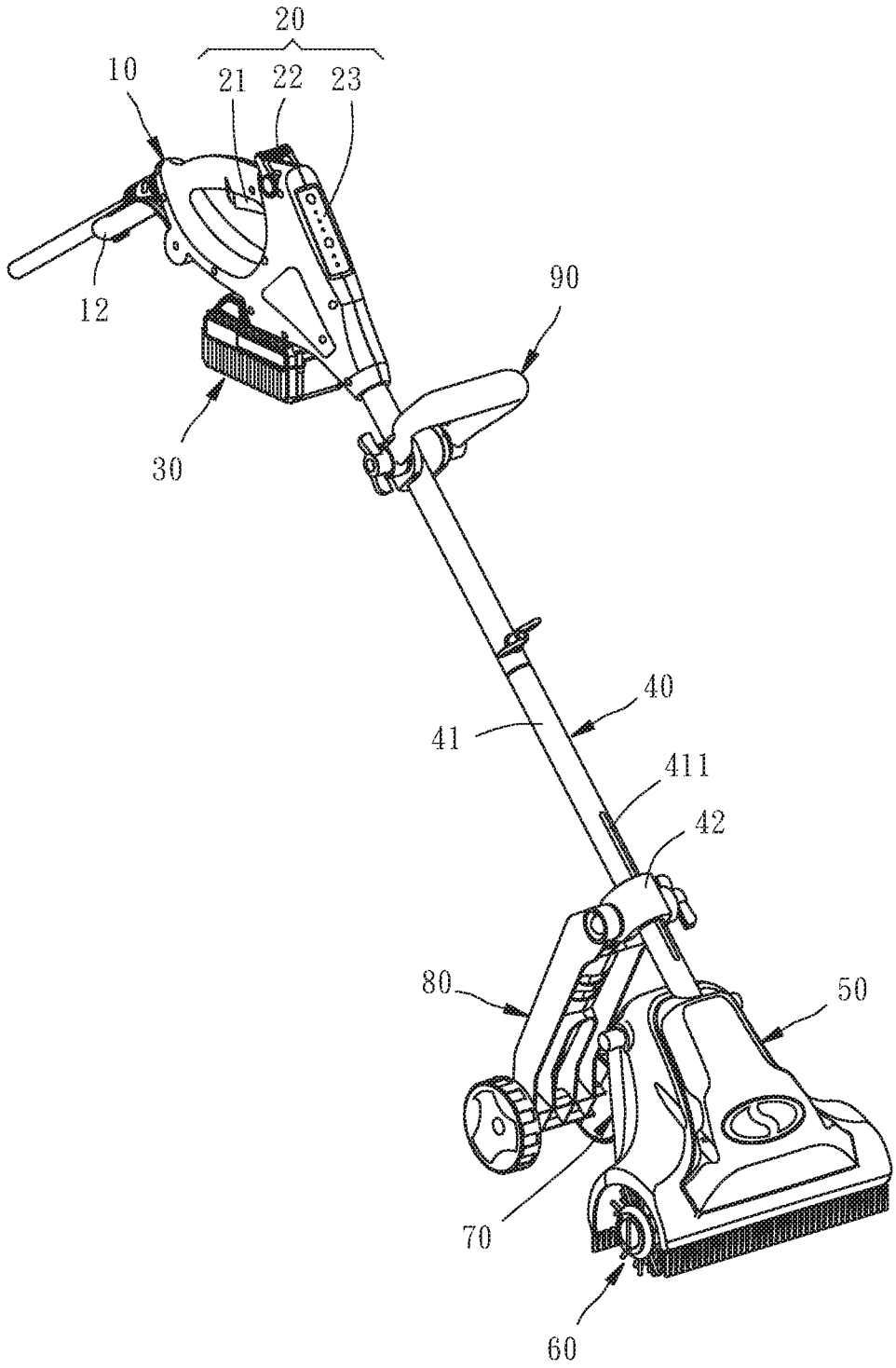
FIG. 1 is a perspective view of a preferred embodiment of the present invention.

A detailed description of the present invention is given below with reference to an embodiment in conjunction with the accompanying drawings.

Referring to FIG. 1 to FIG. 4, the floor washing machine according to a preferred embodiment of the present invention includes a handle assembly 10, a control unit 20, a power supply unit 30, a rod assembly 40, a base assembly 50, a sweeping/scrubbing assembly 60, a water supply assembly 70, a supporting wheel assembly 80, and an auxiliary handle 90.

The handle assembly 10 has a handle body 11 and a guard plate 12 pivotally connected to the handle body 11.

The control unit 20 is provided at the handle assembly 10. The control unit 20 has a switch trigger 21, a flow regulating valve 22, and a setting and display device 23.

The power supply unit 30 is electrically connected to the control unit 20. In this embodiment, the power supply unit 30 is a battery pack provided on the handle assembly 10.

The rod assembly 40 is connected to the handle assembly 10. The rod assembly 40 has a rod member 41 and a collar 42 provided on the rod member 41. The collar 42 can be adjusted in position with respect to the rod member 41.

Figure 5:
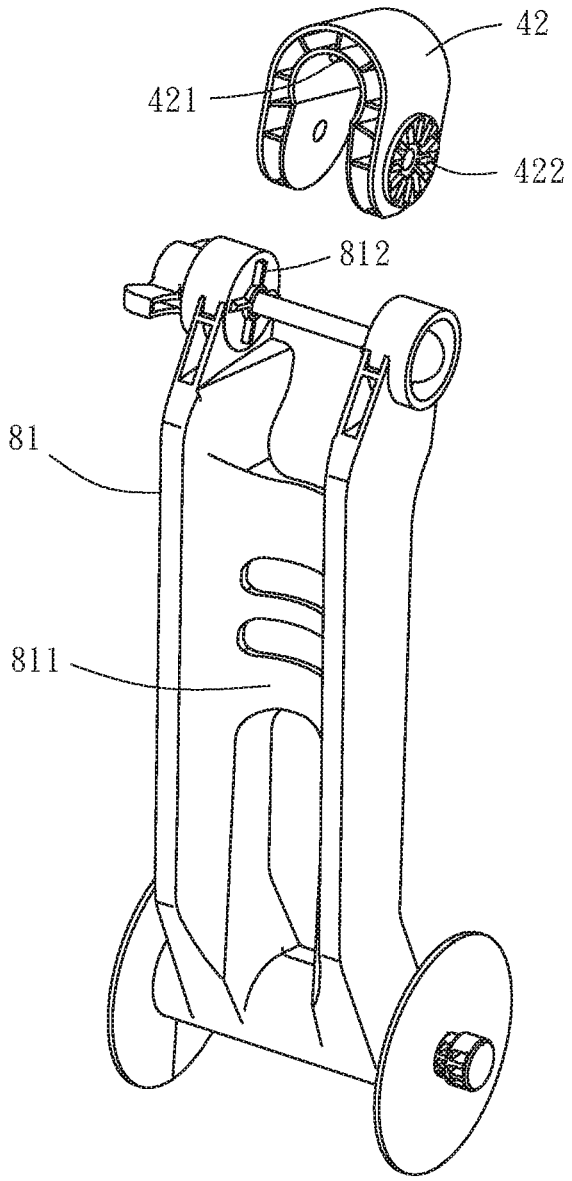
FIG. 5 is an exploded perspective view of the collar and the support arm of the preferred embodiment in FIG. 1.

In this embodiment, the collar 42 is mounted around the rod member 41, the rod member 41 has a slide groove 411, and the collar 42 has a slide block 421 as shown in FIG. 5. The slide block 421 can be slid in, but is also limited in position by, the slide groove 411 of the rod member 41.

The base assembly 50 is connected to a lower portion of the rod assembly 40. The base assembly 50 has two water outlet pipe engaging grooves 51.

The sweeping/scrubbing assembly 60 is provided at the base assembly 50. The sweeping/scrubbing assembly 60 has a motor 61, whose operation is controlled by the control unit 20, and a scrubbing roller 62 to be driven into rotation by the motor 61.

The direction forward of the scrubbing roller 62 is defined as a forward-of-roller direction D1, and the direction rearward of the scrubbing roller 62 is defined as a rearward-of-roller direction D2.

The scrubbing roller 62 can be driven into forward rotation or reverse rotation by the motor 61.

Figure 3:
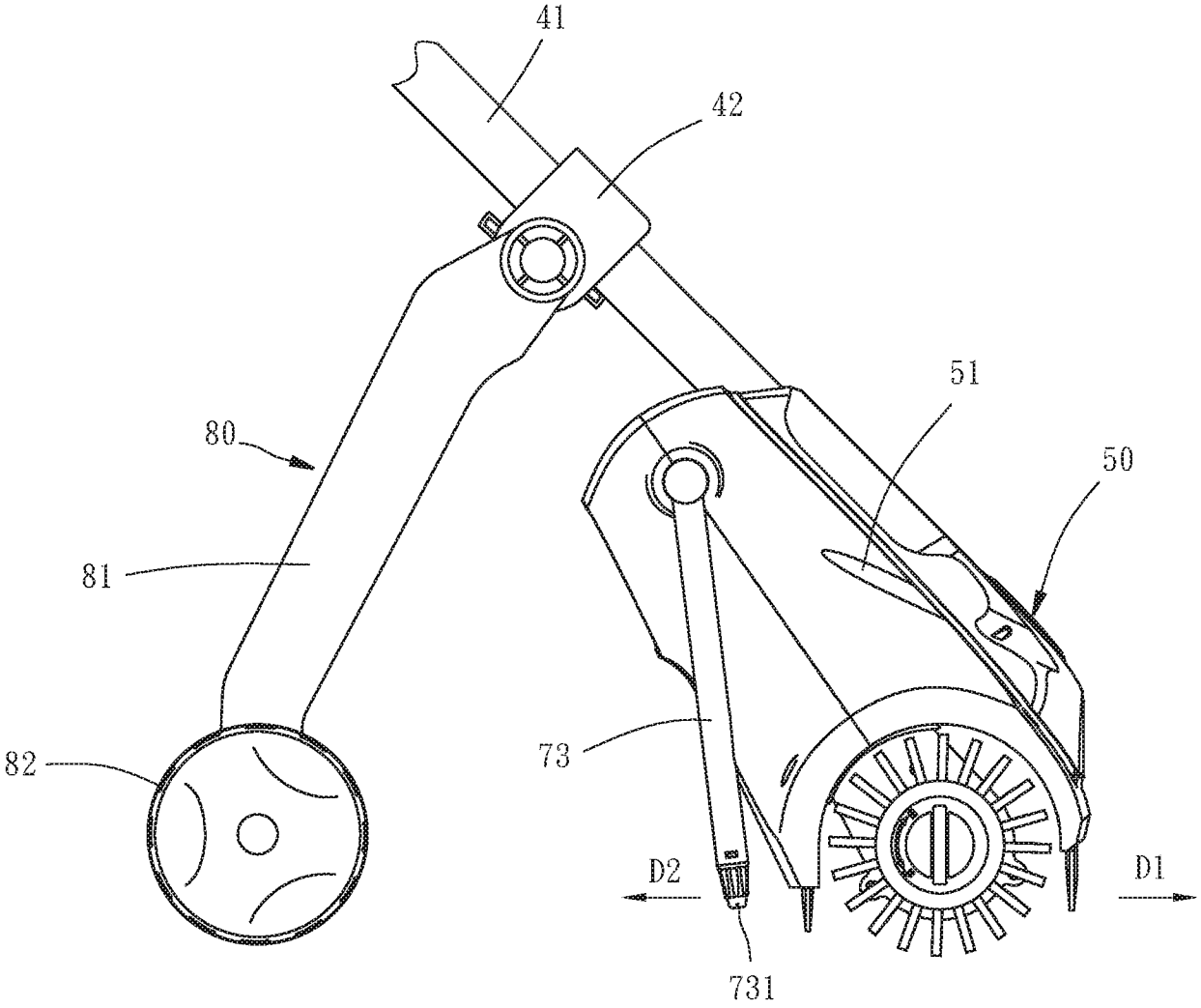
FIG. 3 is a front view of the lower half of the preferred embodiment in FIG. 1, showing in particular a state in which the water outlet opening is in the rearward-of-roller direction.
Figure 4:
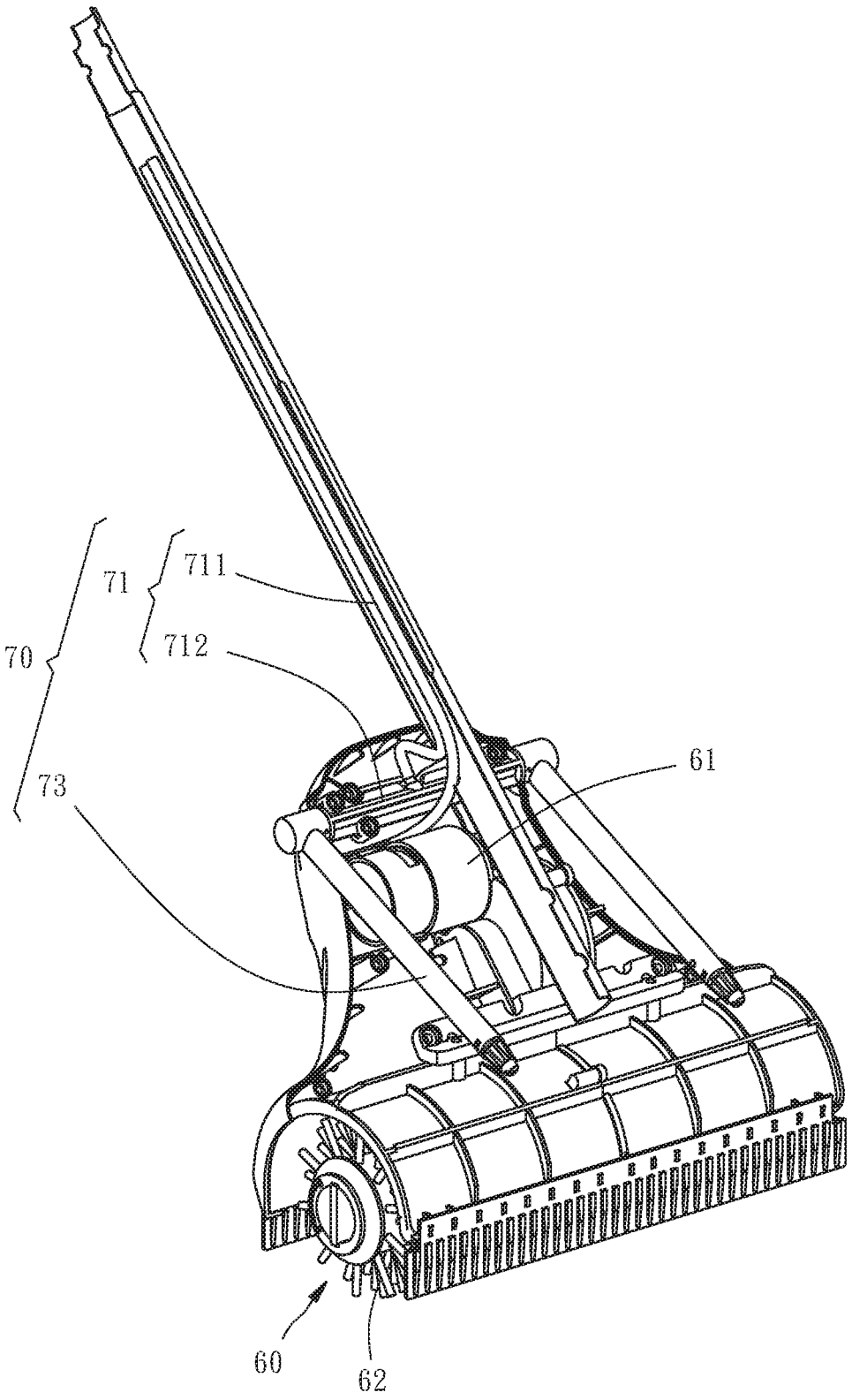
FIG. 4 is a perspective view of the lower half of the preferred embodiment in FIG. 1, with certain elements removed.
Figure 7:
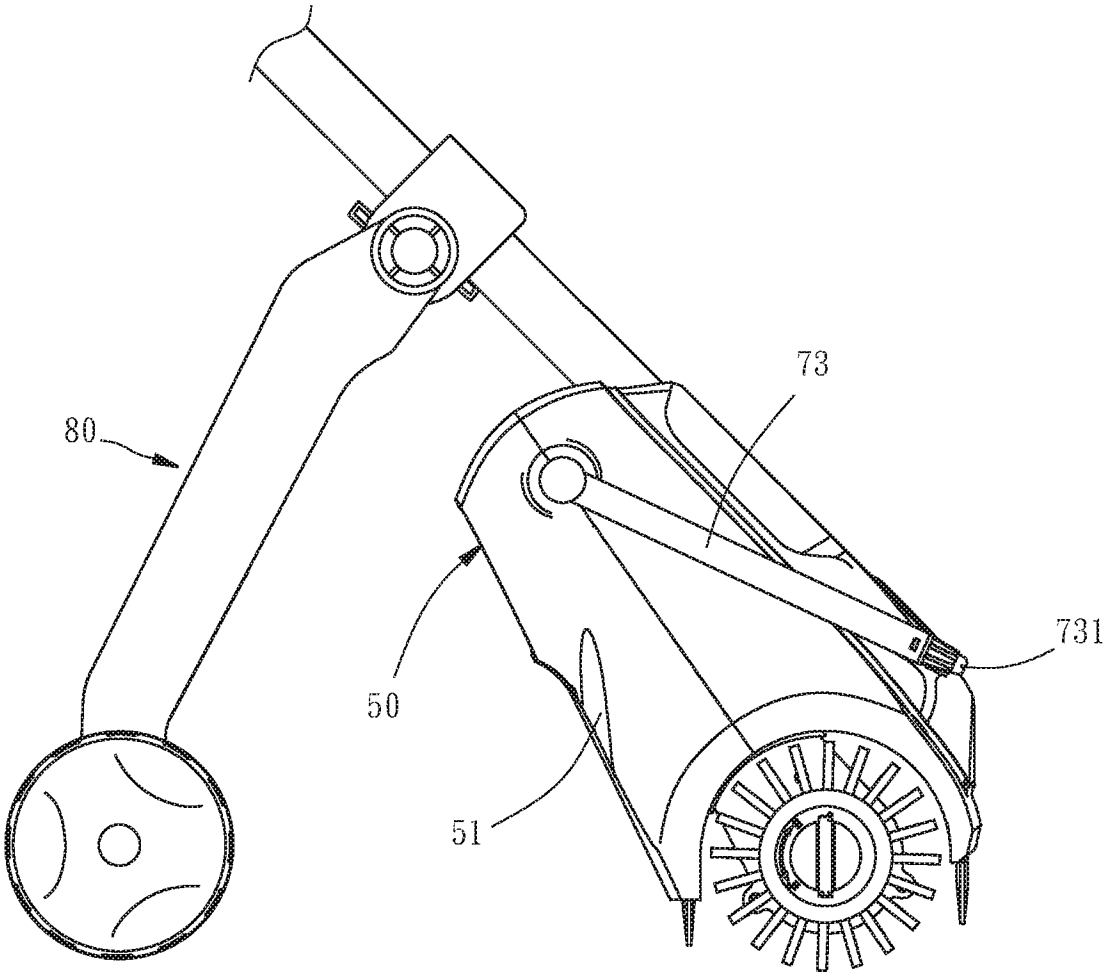
FIG. 7 is generally the same as FIG. 3 except that the water outlet pipe has been moved such that the water outlet opening is in the forward-of-roller direction.

The water supply assembly 70 has a water delivery member 71 and two water outlet pipes 73 rotatably connected to the water delivery member 71. Each water outlet pipe 73 has a water outlet opening 731. The water outlet pipes 73 of the water supply assembly 70 can be rotated in order to point their water outlet openings 731 to the forward-of-roller direction D1 or the rearward-of-roller direction D2 of the sweeping/scrubbing assembly 60. When the scrubbing roller (62) is driven into forward rotation by the motor (61), as shown in FIG. 7, the water outlet opening (731) of the water outlet pipe (73) is located at the forward-of-roller direction (D1), and when the scrubbing roller (62) is driven into reverse rotation by the motor (61), as shown in FIG. 3, the water outlet opening (731) of the water outlet pipe (73) is located at the rearward-of-roller direction (D2).

The water delivery member 71 of the water supply assembly 70 has a first pipe 711 and a second pipe 712 connected to the first pipe 711. The water outlet pipes 73 are connected to the second pipe 712. It is preferable that a sealing ring is provided between each water outlet pipe 73 and the second pipe 712.

Furthermore, the water delivery member 71 of the water supply assembly 70 is connected to and passes through the handle assembly 10 and is connected to a water source pipe 75 via a pipe adapter 74.

The water outlet pipes 73 of the water supply assembly 70 can be positioned in the water outlet pipe engaging grooves 51 of the base assembly 50 respectively.

The switch trigger 21 is configured for use to activate the sweeping/scrubbing assembly 60. The flow regulating valve 22 is configured for use to regulate the amount of water output from the water output pipes 73. The setting and display device 23 is configured for use to set the scrubbing roller 62 of the sweeping/scrubbing assembly 60 to a forward rotation mode or a reverse rotation mode.

Figure 2:
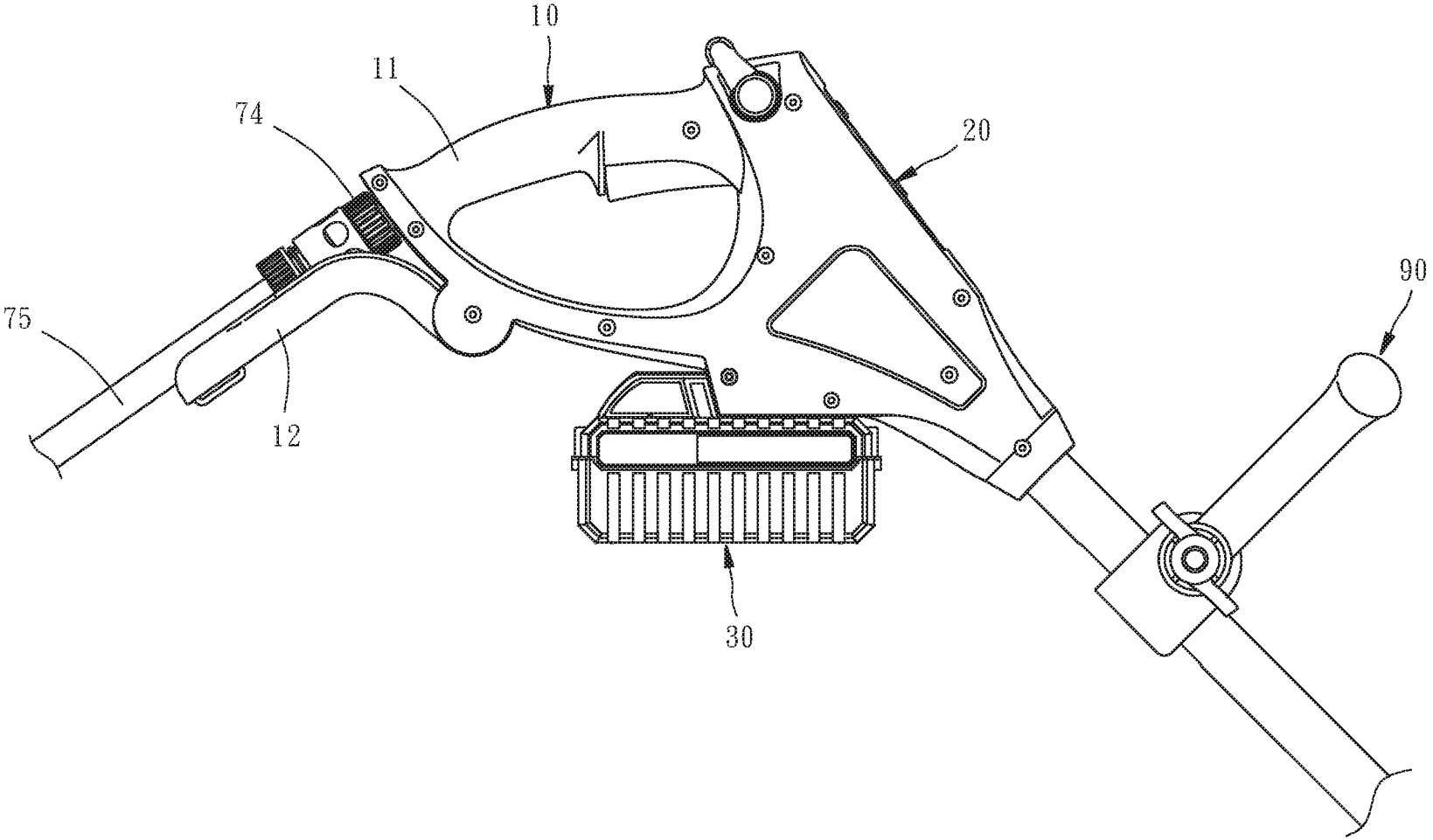
FIG. 2 is a front view of the upper half of the preferred embodiment in FIG. 1.

In FIG. 2, which shows a state of use of the preferred embodiment described above, the guard plate 12 has been rotated to a position for protecting the pipe adapter 74 and the water source pipe 75.

The supporting wheel assembly 80 has a support arm 81 connected to the rod assembly 40 and two wheels 82 pivotally connected to the support arm 81.

The support arm 81 of the supporting wheel assembly 80 is connected to the collar 42 of the rod assembly 40, and as stated above, the collar 42 is provided on, and can be adjusted in position with respect to, the rod member 41. In this embodiment, the support arm 81 of the supporting wheel assembly 80 is connected to the collar 42 via a bolt.

The collar 42 of the rod assembly 40 has a plurality of positioning grooves 422, and the support arm 81 of the supporting wheel assembly 80 is formed with a plurality of positioning teeth 812. The positioning teeth 812 are configured to be engaged in the corresponding positioning grooves 422 of the collar 42 respectively, with a view to securing the supporting wheel assembly 80 at an arbitrary one of a plurality of predetermined rotated positions.

The support arm 81 of the supporting wheel assembly 80 is formed with an arm groove 811 for receiving the rod member 41 of the rod assembly 40.

The auxiliary handle 90 is connected to the rod assembly 40. In this embodiment, the auxiliary handle 90 is connected to the rod assembly 40 via a bolt.

Figure 6:
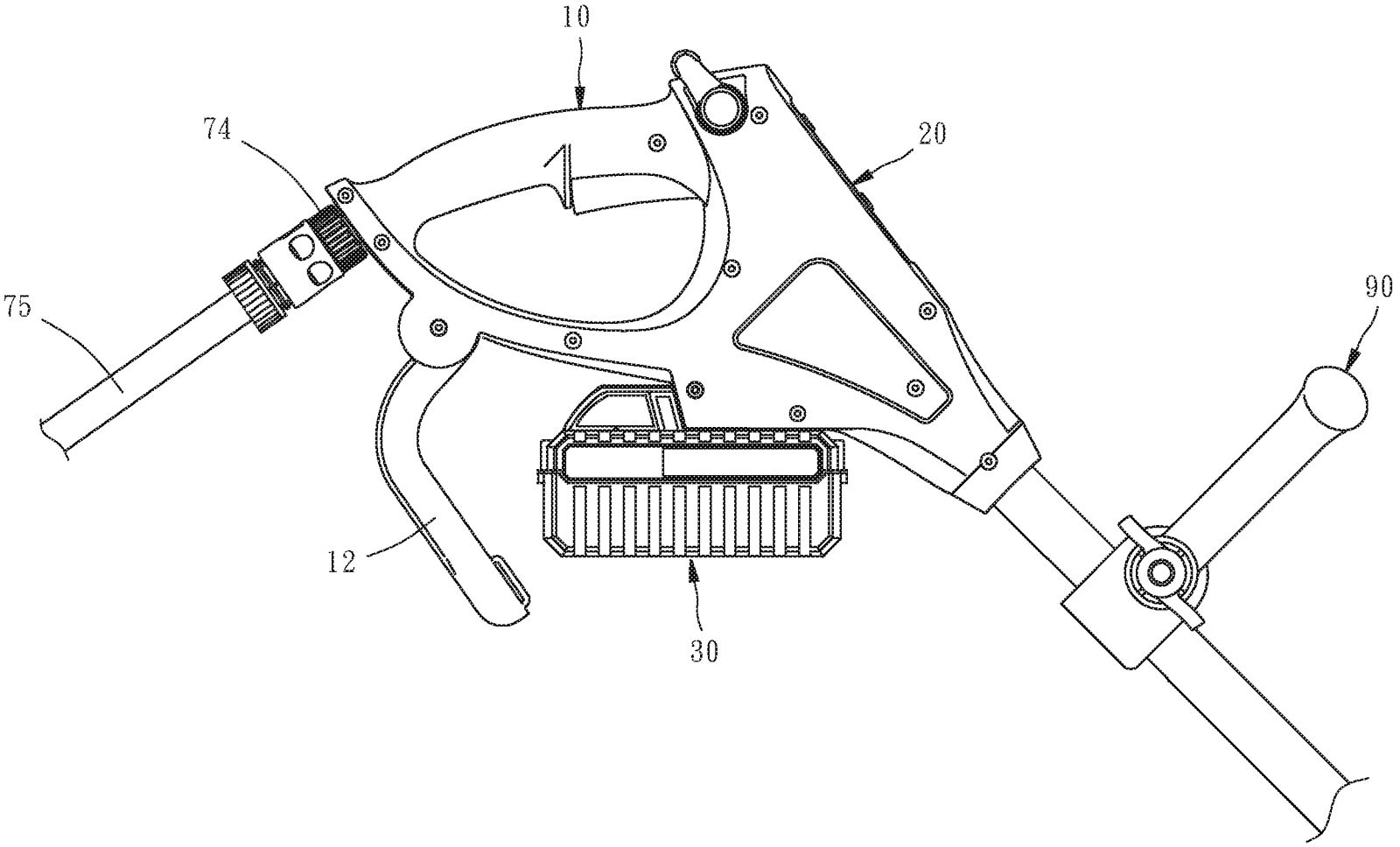
FIG. 6 is generally the same as FIG. 2 except that the guard plate has been moved.

The foregoing preferred embodiment can be operated and adjusted as follows:

Referring to FIG. 6 for another state of use of the preferred embodiment, the guard plate 12 has been rotated to a position for protecting the power supply unit 30. That is to say, the guard plate 12 of the handle assembly 10 can be pivoted to shield the power supply unit 30 or the water source pipe 75 as needed.

Referring to FIG. 7 for still another state of use of the preferred embodiment, the water outlet pipes 73 have been rotated to the forward position.

Figure 8:
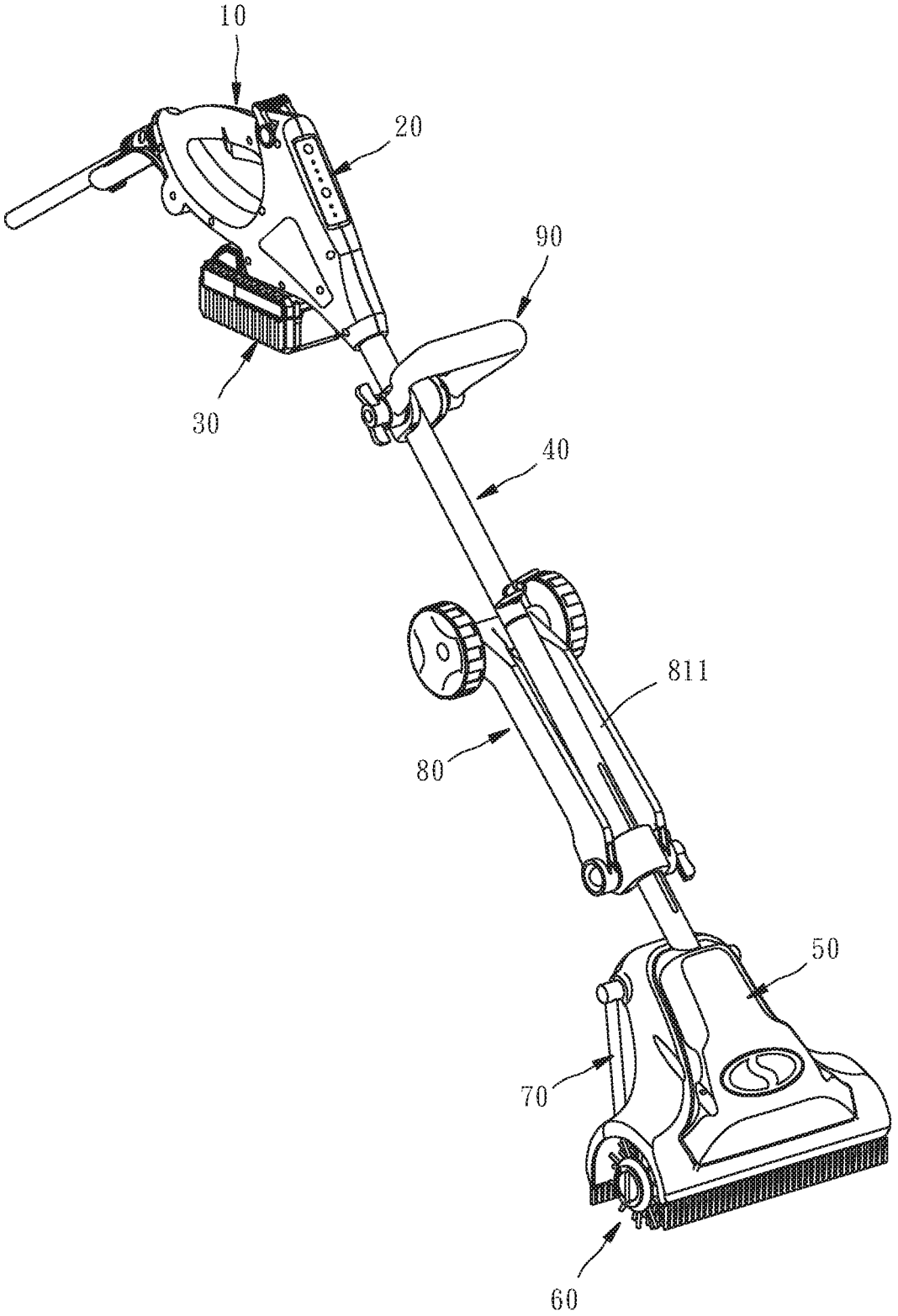
FIG. 8 is generally the same as FIG. 1 except that the supporting wheel assembly has been moved into a folded state.
Figure 9:
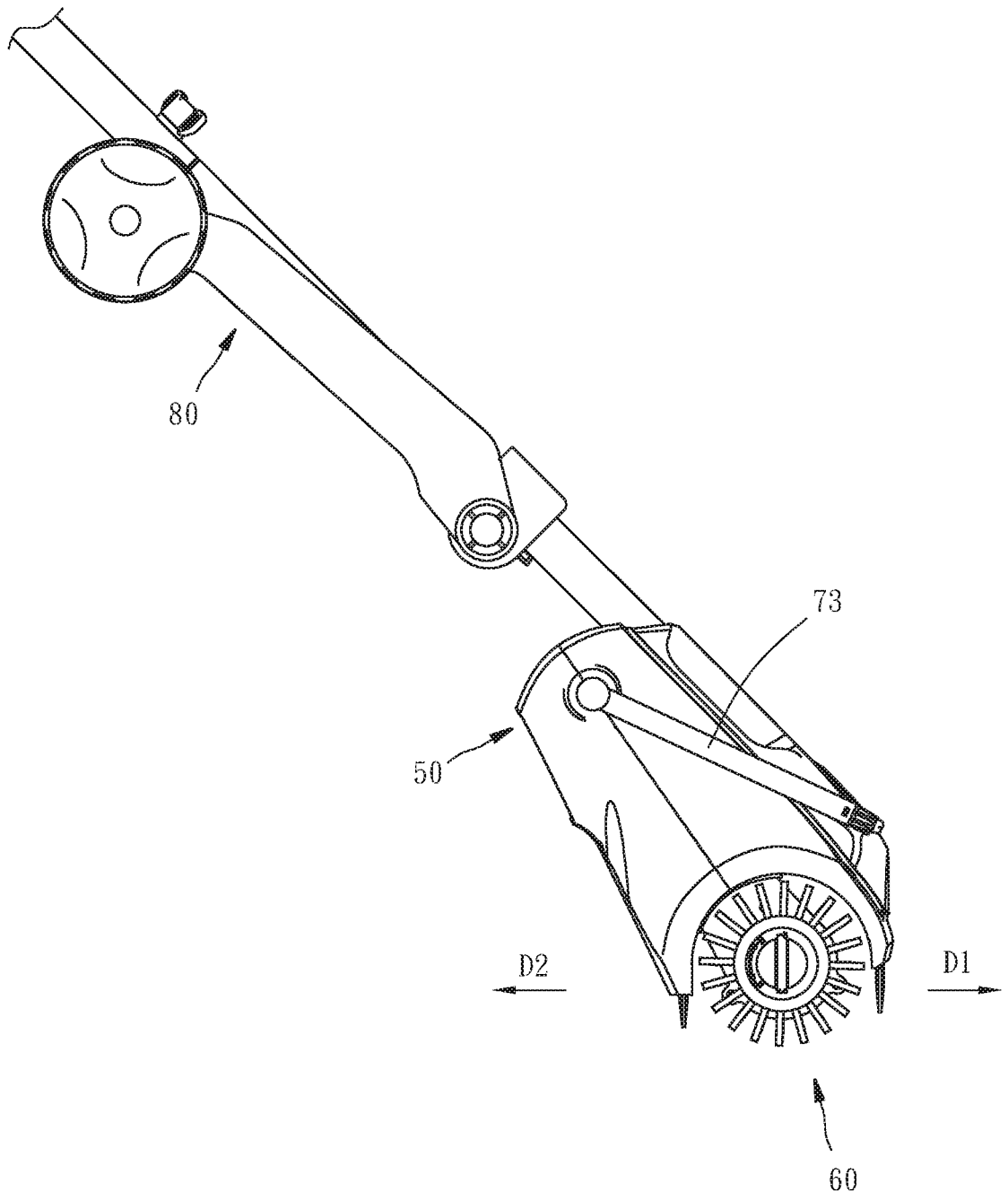
FIG. 9 is a front view of the lower half of the preferred embodiment in FIG. 8.

Referring to FIG. 8 and FIG. 9 for yet another state of use of the preferred embodiment, the supporting wheel assembly 80 has been folded up against the rod assembly 40.

The embodiment described above is so designed that the water outlet pipes 73 of the water supply assembly 70 can be adjusted in position, or more particularly rotated, in order to spray water in the forward or rearward direction of the scrubbing roller 62, thereby allowing the scrubbing roller 62 to perform effective water-assisted cleaning while being moved forward or rearward.

With the supporting wheel assembly 80 serving as a supporting element, the force required to be exerted by the user's hand can be reduced.

Besides, the power supply unit 30 in the present invention is not limited to the battery pack disclosed herein and may be a power source connecting device instead.

The power supply unit 30 in the present invention may be configured to supply direct-current or alternating-current electricity.

What is claimed is:

1. A floor washing machine, comprising:

a handle assembly (10) having a handle body (11);

a control unit (20) provided at the handle assembly (10);

a power supply unit (30) electrically connected to the control unit (20);

a rod assembly (40) connected to the handle assembly (10), the rod assembly (40) having a rod member (41);

a base assembly (50) connected to a lower portion of the rod assembly (40);

a sweeping/scrubbing assembly (60) provided at the base assembly (50), the sweeping/scrubbing assembly (60) having a motor (61) configured to operate under control of the control unit (20) and a scrubbing roller (62) configured to be driven into rotation by the motor (61), wherein a direction forward of the scrubbing roller (62) and a direction rearward of the scrubbing roller (62) are defined as a forward-of-roller direction (D1) and a rearward-of-roller direction (D2) respectively, and wherein the scrubbing roller (62) is able to be driven into forward rotation or reverse rotation by the motor (61); and a water supply assembly (70) having a water delivery member (71) and a water outlet pipe (73) rotatably connected to the water delivery member (71), the water outlet pipe (73) having a water outlet opening (731), the water outlet pipe (73) of the water supply assembly (70) being rotatable in order to point the water outlet opening (731) to the forward-of-roller direction (D1) or the rearward-of-roller direction (D2) of the sweeping/scrubbing assembly (60);

wherein when the scrubbing roller (62) is driven into forward rotation by the motor (61), the water outlet opening (731) of the water outlet pipe (73) is located at the forward-of-roller direction (D1), and when the scrubbing roller (62) is driven into reverse rotation by the motor (61), the water outlet opening (731) of the water outlet pipe (73) is located at the rearward-of-roller direction (D2).

2. The floor washing machine of claim 1, wherein the water delivery member (71) of the water supply assembly (70) has a first pipe (711) and a second pipe (712) connected to the first pipe (711), and the water outlet pipe (73) is connected to the second pipe (712).

3. The floor washing machine of claim 1, wherein the base assembly (50) has a water outlet pipe engaging groove (51), and the water outlet pipe (73) of the water supply assembly (70) is able to be positioned in the water outlet pipe engaging groove (51) of the base assembly (50).

4. The floor washing machine of claim 1, wherein the water delivery member (71) of the water supply assembly (70) is connected to and extends through the handle assembly (10).

5. The floor washing machine of claim 1, further comprising a supporting wheel assembly (80), the supporting wheel assembly (80) having a support arm (81) connected to the rod assembly (40) and a wheel (82) pivotally connected to the support arm (81).

6. The floor washing machine of claim 5, wherein the rod assembly (40) has a collar (42) provided on the rod member (41) in a position-adjustable manner, and the support arm (81) of the supporting wheel assembly (80) is connected to the collar (42).

7. The floor washing machine of claim 6, wherein the collar (42) of the rod assembly (40) has a plurality of positioning grooves (422), and the support arm (81) of the supporting wheel assembly (80) is formed with a plurality of positioning teeth (812) configured to be respectively engaged in corresponding ones of the positioning grooves (422) of the collar (42) in order to secure the supporting wheel assembly (80) at an arbitrary one of a plurality of predetermined rotated positions.

8. The floor washing machine of claim 5, wherein the support arm (81) of the supporting wheel assembly (80) is formed with an arm groove (811) for receiving the rod member (41) of the rod assembly (40).

9. The floor washing machine of claim 1, wherein the power supply unit (30) is provided under the handle assembly (10), the water delivery member (71) of the water supply assembly (70) is connected to a water source pipe (75), and the handle assembly (10) has a guard plate (12) configured to be pivoted so as to shield the power supply unit (30) or the water source pipe (75).

10. The floor washing machine of claim 1, wherein the control unit (20) has a switch trigger (21), a flow regulating valve (22), and a setting and display device (23), the switch trigger (21) is configured for use to activate the sweeping/scrubbing assembly (60), the flow regulating valve (22) is configured for use to regulate the amount of water output from the water outlet pipe (73), and the setting and display device (23) is configured for use to set the scrubbing roller (62) of the sweeping/scrubbing assembly (60) to a forward or reverse rotation mode.

* * * * *